US010344775B2

(12) United States Patent
Koga et al.

(10) Patent No.: US 10,344,775 B2
(45) Date of Patent: Jul. 9, 2019

(54) WATER PUMP

(71) Applicant: AISIN SEIKI KABUSHIKI KAISHA, Kariya-shi, Aichi (JP)

(72) Inventors: Yojiro Koga, Kariya (JP); Yoshiaki Nakano, Toyohashi (JP); Kenichi Komai, Toyota (JP); Megumi Onozuka, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 435 days.

(21) Appl. No.: 15/109,508

(22) PCT Filed: Sep. 3, 2014

(86) PCT No.: PCT/JP2014/073166
§ 371 (c)(1),
(2) Date: Jul. 1, 2016

(87) PCT Pub. No.: WO2015/104866
PCT Pub. Date: Jul. 16, 2015

(65) Prior Publication Data

US 2016/0333891 A1 Nov. 17, 2016

(30) Foreign Application Priority Data

Jan. 8, 2014 (JP) ..... 2014-001892

(51) Int. Cl.
*F04D 29/62* (2006.01)
*F04D 29/22* (2006.01)
(Continued)

(52) U.S. Cl.
CPC ..... *F04D 29/628* (2013.01); *F01P 5/12* (2013.01); *F04D 13/02* (2013.01); *F04D 29/086* (2013.01);
(Continued)

(58) Field of Classification Search
CPC .... F04D 29/086; F04D 29/146; F04D 29/628; F01P 5/12
See application file for complete search history.

(56) References Cited

U.S. PATENT DOCUMENTS 3,059,582 A * 10/1962 Greene ..... F04D 29/426 285/367
3,068,801 A * 12/1962 Murray ..... F04D 29/146 277/387
(Continued)

FOREIGN PATENT DOCUMENTS

JP 2008-169763 A 7/2008

OTHER PUBLICATIONS

International Search Report (PCT/ISA/210) dated Dec. 2, 2014, by the Japanese Patent Office as the International Searching Authority for International Application No. PCT/JP2014/073166.
(Continued)

*Primary Examiner* — Jason D Shanske
*Assistant Examiner* — Brian O Peters
(74) *Attorney, Agent, or Firm* — Buchanan Ingersoll & Rooney PC

(57) ABSTRACT

Realized is a water pump having improved readiness of maintenance. The water pump includes a first unit having a rotatably driven drive shaft and a second unit having a partition wall and configured to circulate cooling medium in association with rotation of the drive shaft. The first unit and the second unit are connectable to and detachable from each other. The partition wall defines an insertion hole for the drive shaft. In this arrangement, there is provided a closing member for closing the insertion hole of the partition wall when the first unit is detached from the second unit.

5 Claims, 5 Drawing Sheets

(51) Int. Cl.

| | |
|---|---|
| ***F04D 29/14*** | (2006.01) |
| ***F04D 29/42*** | (2006.01) |
| ***F01P 5/12*** | (2006.01) |
| ***F04D 13/02*** | (2006.01) |
| ***F04D 29/08*** | (2006.01) |

(52) U.S. Cl.
CPC ..... *F04D 29/146* (2013.01); *F04D 29/2266* (2013.01); *F04D 29/426* (2013.01)

(56) References Cited

U.S. PATENT DOCUMENTS 4,415,167 A * 11/1983 Gits ..... F16J 15/36
277/373
2008/0115745 A1* 5/2008 Kawaike ..... F01P 5/04
123/41.02

OTHER PUBLICATIONS

Written Opinion (PCT/ISA/237) dated Dec. 2, 2014, by the Japanese Patent Office as the International Searching Authority for International Application No. PCT/JP2014/073166.

* cited by examiner

WATER PUMP

TECHNICAL FIELD

This invention relates to a water pump.

BACKGROUND ART

Patent Document 1 discloses a water pump including a pump body supported by a cylinder block of an engine and a rotational shaft rotatably supported via a bearing to the pump body. A drive pulley is mounted at one end portion of this rotational shaft and an impeller is pressure-fixed to the other end portion of the rotational shaft.

This water pump is configured such that as a drive force of the engine is transmitted to the drive pulley, the impeller is rotated thereby to effect circulation of cooling water for the engine.

CITATION LIST

Patent Literature

Patent Document 1: JP 2008-169763A

SUMMARY OF INVENTION

Technical Problem

With a water pump configured to circulate cooling water for an engine, a maintenance operation such as replacement of the bearing supporting the rotational shaft, replacement of a mechanical seal, etc. is sometimes needed.

However, with the water pump disclosed in Patent Document 1, even for replacement of the bearing, the rotational shaft and the impeller need to be removed. So, an operation of draining cooling water from the engine needs to be effected, thus, the maintenance would be troublesome.

The object of the present invention is to rationally realize a water pump having improved readiness of maintenance.

Solution to Problem

According to a characterizing feature of the present invention: A water pump comprises: a first unit having a drive shaft rotatably driven; and a second unit having a partition wall defining an insertion hole for the drive shaft, the second unit being configured to circulate cooling medium in association with rotation of the drive shaft, the second unit being connectable to and detachable from the first unit via the partition wall; wherein the second unit includes a closing member for closing the insertion hole when the first unit is detached from the second unit while the second unit is supported to an internal combustion engine.

With this arrangement, as the drive shaft is inserted through the insertion hole of the partition wall, cooling medium can be circulated in association with rotation of the drive shaft. Further, while the second unit remains in the internal combustion engine, if the first unit including the drive shaft is detached from this second unit supported to the internal combustion engine, the insertion hole of the partition wall is closed by the closing member, so no leakage of cooling water to the outside will occur. In this way, when a maintenance operation is to be carried out, such operation as draining of cooling medium and replenishment of the cooling medium after assembly, etc. is not needed. Thus, there has been rationally realized a water pump having improved readiness of maintenance.

According to a further characterizing feature: the second unit includes an impeller for circulating the cooling medium; and the impeller is configured to be able to approach the partition wall along an extending direction of the drive shaft, thus constituting the closing member.

With this arrangement, by moving the impeller in the direction approaching the partition wall along the extending direction of the drive shaft to come into gapless contact with the partition wall, the insertion hole can be closed by this impeller. Thus, this impeller can be used also as the closing member. With this, there is no need to provide the closing member separately, thus not needing to increase the number of components.

According to a further characterizing feature, the second unit includes an urging member for urging the impeller to a side of the partition wall.

With this arrangement, when the first unit is detached from the second unit, under the urging force of the urging member, the impeller can be displaced toward and come into gapless contact with the partition wall along the extending direction of the drive shaft. With this, without need of an operation of manually closing the insertion hole, a closed state of the insertion hole can be speedily realized, so almost no leakage of cooling water will occur.

According to a further characterizing feature: the impeller is supported rotatably by a support shaft disposed on a side opposite to the partition wall; the second unit includes a supporting member for supporting the support shaft; and a coil spring acting as the urging member is disposed between the supporting member and the impeller.

With this arrangement, in case the drive shaft is detached from the impeller, the impeller can be supported by the support shaft and maintained on the rotational axis. Further, as the impeller is displaced along the support shaft by the urging force of the coil spring, the impeller can be fed in the direction toward the partition wall under its optimal posture for closing the insertion hole of the partition wall, so that the insertion hole can be closed in a reliable manner.

According to a further characterizing feature, the impeller includes an engaging hole formed on the partition wall side and connected with the drive shaft and a supporting hole formed on the side opposite to the partition wall and allowing insertion of the support shaft therein, the engaging hole and the supporting hole being formed independently so as not to communicate with each other.

With this arrangement, the impeller receives transmission of rotation of the drive shaft through the engaging hole and also the impeller can be maintained on the rotational axis by the support shaft via the supporting hole. Namely, as the impeller is supported along the rotational axis by both the drive shaft and the support shaft, the rotational posture of the impeller can be stable. Moreover, since the engaging hole and the supporting hole are not communicated and formed independently or each other, there occurs no passage of the cooling medium inside the impeller. Therefore, as the impeller closes the insertion hole of the partition wall, no leakage of cooling water occurs.

According to a further characterizing feature, the impeller includes, on a face thereof facing the partition wall, an elastically deformable resin layer.

With this arrangement, when the impeller is displaced toward the partition wall, the resin layer is deformed elastically, thus enhancing the closeness of contact between the impeller and the partition wall, so that the insertion hole can be closed in a reliable manner.

According to a further characterizing feature, the first unit includes a drain passage capable of discharging the cooling medium to be stored in a communication chamber provided in mating faces of the first unit and the second unit, before the first unit is detached from the second unit.

With this water pump, the cooling medium will flow and leak through the insertion hole into the communication chamber provided in the mating faces of the first unit and the second unit. With this arrangement, the cooling medium leaked into the communication chamber will be drained through the drain passage provided in the communication chamber in advance, then, the first unit will be removed. With this, the readiness of maintenance can be improved.

DESCRIPTION OF EMBODIMENTS

Next, embodiments of the present invention will be explained with reference to the accompanying drawings.

[General Configuration]

Figure 1:
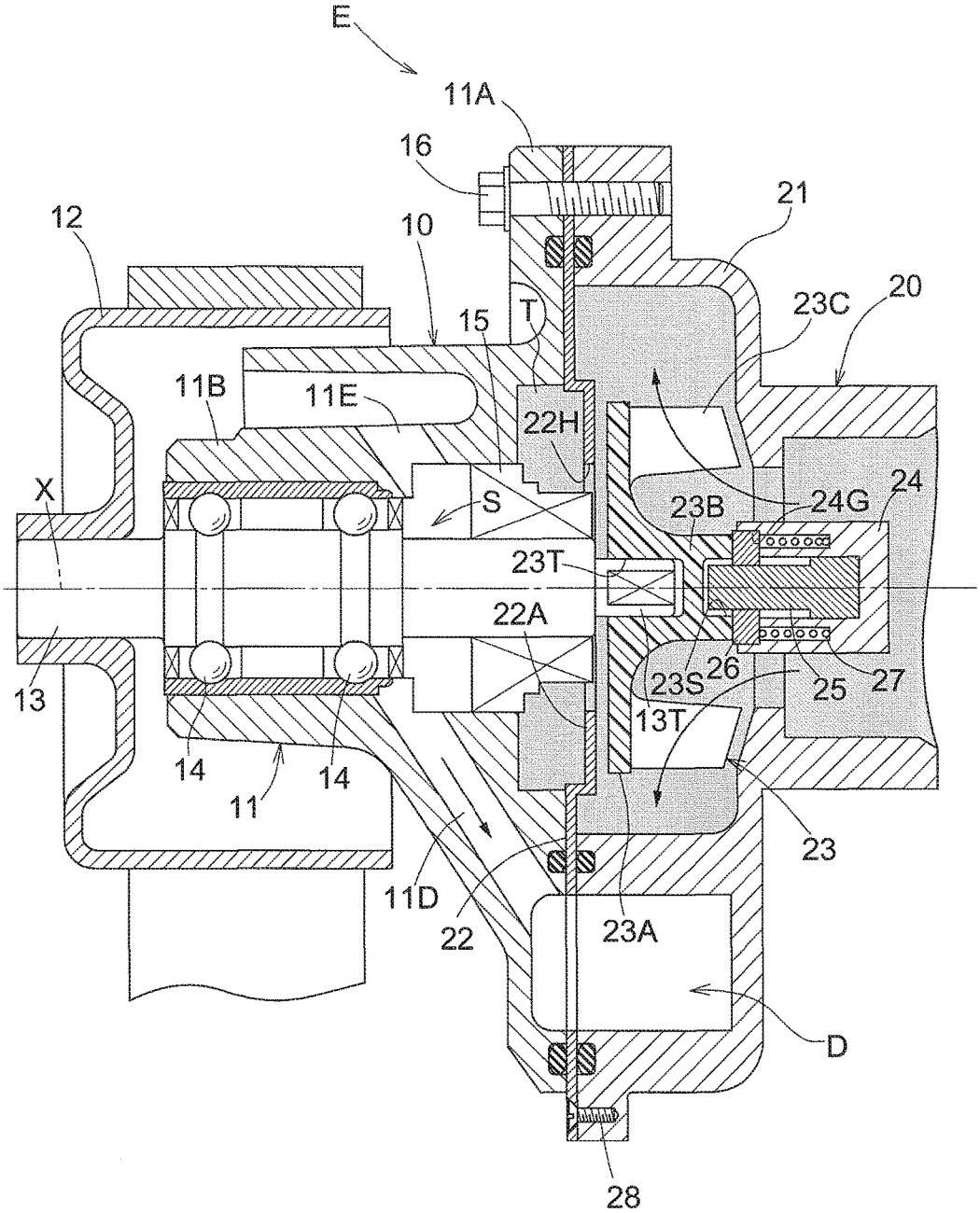
FIG. 1 is a section view showing a water pump at the time of its operation.
Figure 2:
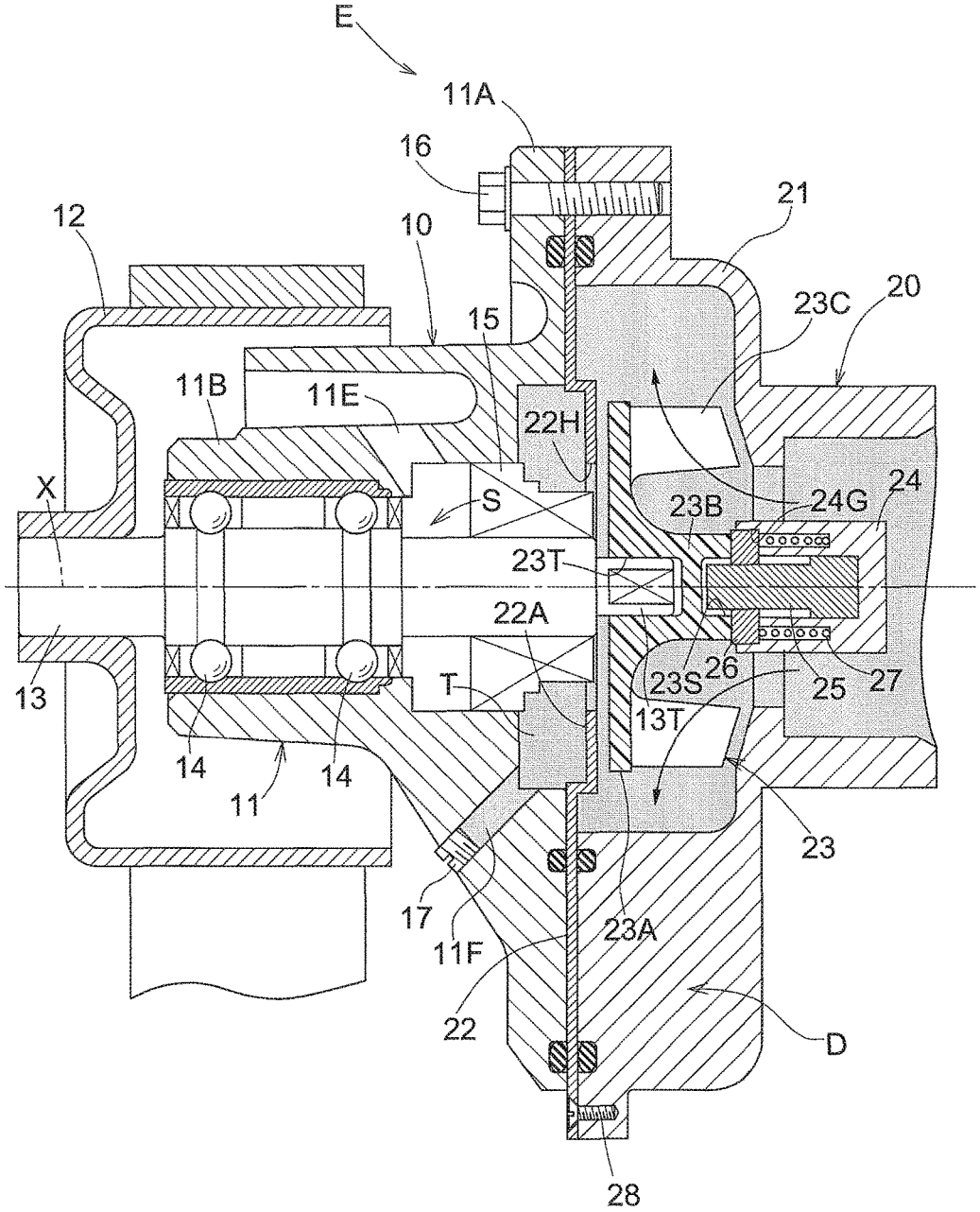
FIG. 2 is a section view of the water pump showing a drain passage.
Figure 3:
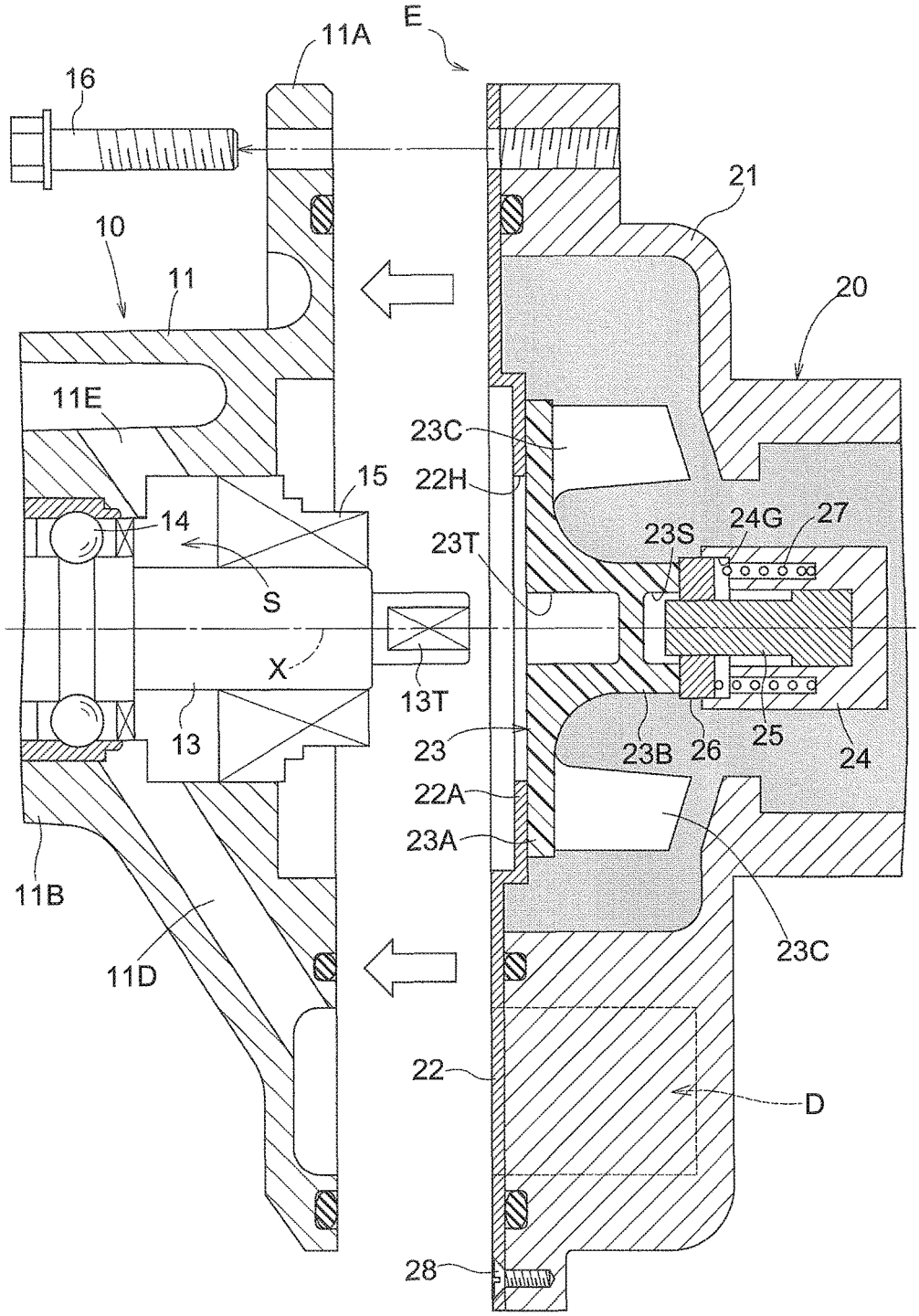
FIG. 3 is a section view of the water pump under a detached state.

As shown in FIGS. 1 through 3, a water pump comprises a first unit 10 having a drive shaft 13 rotatable by rotational drive force from a pulley 12, and a second unit 20 having a partition wall 22 defining an insertion hole 22H through which the drive shaft 13 is inserted and an impeller 23 (an example of "a closing member") rotatable by a drive force from the drive shaft 13, the second unit 20 being detachable from the first unit 10.

With this water pump in operation, a drive force from a crankshaft of an engine E of a passenger automobile or the like is transmitted to the pulley 12 via an endless belt and as this rotational drive force is transmitted from the drive shaft 13 to the impeller 23, there is realized circulation of cooling water (an example of "cooling medium") inside the engine.

FIG. 1 and FIG. 2 show a state when the first unit 10 and the second unit 20 are connected to each other. Under this connected state, the impeller 23 and the drive shaft 13 are disposed on a same axis as a rotational axis X, and an engaging portion 13T formed at one end portion of the drive shaft 13 is engaged and connected to an engaging hole 23T formed in the impeller 23. The engaging hole 23T is configured to be switchable between an engaged state where the hole 23T is engaged with the engaging portion 13T and a detached state detached therefrom. And, under the engaged state, torque of the drive shaft 13 can be transmitted to the impeller 23.

Incidentally, cross sectional shape of the engaging portion 13T and the engaging hole 23T can be non-circular to be able to transmit the torque. For instance, the cross sectional shapes can be D-cut shape, a width across flats shape, an internal gear teeth shape such as a spline, etc.

With this water pump, the impeller 23 can move closer to the partition wall 22 through its displacement in a direction along the rotational axis X (the extending direction of the drive shaft 13). With this, for instance, when the first unit 10 is detached from the second unit 20 at the time of a maintenance operation, the impeller 23 is displaced to a position covering the insertion hole 22H of the partition wall 22, thus closing this insertion hole 22H, whereby leakage of the cooling water is prevented. Namely, the impeller 23 acts as "a closing member".

[First Unit]

The first unit 10 includes a first unit housing 11 formed integrally of a flange-like portion 11A and a shaft supporting portion 11B protruding outwards from the flange-like portion 11A along the rotational axis X and rotatably supporting the drive shaft 13. This first unit housing 11 includes ball bearings 14 acting as a bearing for rotatably supporting the drive shaft 13 and a mechanical seal 15 for preventing leakage of cooling water.

The inner end portion (one end portion) of the drive shaft 13 is disposed at the position extending through the insertion hole 22H of the partition wall 22 and at this inner end portion, there is formed the above-described engaging portion 13T. Further, at the outer end portion (the other end portion) of the drive shaft 13, the pulley 12 is connected and fixed. On and around this pulley 12, a drive belt driven by the crankshaft of the engine E is entrained.

At the shaft supporting portion 11B, there is formed an inner space S surrounding the drive shaft 13 on more outer end side than the mechanical seal 15. On the more inner side than the mechanical seal 15, a communication chamber T is formed. In the first unit 10, there are formed a drain collecting passage 11D for sending an amount of cooling water leaked into the inner space S downwards and a communication passage 11E allowing introduction of air into this inner space S. Further, in a region extending between the first unit housing 11 and a second unit housing 21, there is formed a reservoir space D for reserving an amount of cooling water sent from the drain collecting passage 11D. Further, a drain passage 11F capable of draining the cooling water of the communication chamber T to the outside is formed in the first unit 10. And, in this drain passage 11F, there is provided a plug member 17 that can be opened and closed.

With formation of this drain collecting passage 11D, in case cooling water leaks into the inner space S along the outer circumferential face of the drive shaft 13 at the position of the mechanical seal 15, this cooling water will be guided downwards by the drain collecting passage 11D and can be reserved in the reservoir space D.

The first unit housing 11 is connected to the second unit 20 via a plurality of connecting bolts 16 extending through the flange-like portion 11A. Therefore, by releasing the fastening with these connecting bolts 16, the first unit housing 11 can be detached from the second unit 20. Further, when such detachment is to be effected, the plug member 17 of the drain passage 11F will be removed and the cooling water in the communication chamber T will be drained through the drain passage 11F in advance. With this, readiness of maintenance can be improved.

[Second Unit]

The second unit 20 includes the second unit housing 21 forming a case-like outer wall and also a plate-like partition wall 22 disposed at the position for closing an opening portion of this second unit housing 21, and the impeller 23 is accommodated inside this second unit housing 21.

The drive shaft 13 and the impeller 23 are disposed on the same axis as the rotational axis X and there is provided a support shaft 25 coaxial with the rotational axis X for supporting a supporting member 24 supported inside the second unit housing 21.

The impeller 23 comprises an integral assembly made of resin having high durability such as PPS resin, consisting of a circular disc portion 23A, a boss portion 23B formed to project at the center of this disc portion 23A, and a plurality of wing members 23C formed on the outer circumference side of the boss portion 23B. In the boss portion 23B, on the outer end side thereof (the disc portion side), the engaging hole 23T is formed and on the inner end side, a supporting hole 23S is formed. And, the engaging hole 23T and the supporting hole 23S are formed independently of each other, with no communication therebetween.

Incidentally, this impeller 13, as a whole, is formed of a metal or a resin. And, by forming a flexibly deformable resin layer on the face of the disc portion 23A facing the partition wall 22, the closeness of contact relative to the partition wall 22 can be improved.

The support shaft 25 has its protruding-side end portion inserted into the supporting hole 23S of the impeller 23, thus rotatably supporting the impeller 23. Further, the support shaft 25 functions as a guide member for maintaining a posture of the impeller 23 in case the impeller 23 is displaced in the direction approaching the partition wall 22 and in case the impeller 23 is displaced in the direction away from the partition wall 22. Moreover, the support shaft 25 functions also as a maintaining member for maintaining the impeller 23 on the rotational axis X when the drive shaft 13 is detached from the impeller 23. With these functions, at the timing of the impeller 23 coming into contact with the partition wall 22, the disc portion 23A and the partition wall 22 become parallel to each other, so that the impeller can be placed in gapless contact with the partition wall 22. Moreover, under the detached state of the drive shaft 13, the impeller 23 can be maintained in its position.

Further, on the support shaft 25, a washer 26 is loosely fitted. The supporting member 24 accommodates a coil spring 27 (an example of "urging means") for applying an urging force to the impeller 23 via the washer 26. This coil spring 27 functions as an urging member for displacing this impeller 23 in the direction along the rotational axis X (the extending direction of the drive shaft 13) and pressing the impeller 23 against the partition wall 22. And, the washer 26 functions also as a sliding member rotatable relative to the impeller 23.

The supporting member 24 forms a guide portion 24G that engages with the outer circumference of the washer 26, thereby to support this washer 26 non-rotatably, but slidably along the direction of the rotational axis X. As a specific arrangement therefor, the outer circumference of the washer 26 has a non-circular shape such as a hexagonal shape, whereas in the inner circumference of the opening of the supporting member 24, as the guide portion 24G, there is formed an engaging face having a non-circular shape such as a hexagonal shape engageable with the outer circumference of the washer 26.

The washer 26 is formed of a material containing or coated with e.g. fluorine, Teflon (registered trademark) etc. having low-friction property, or of stainless steel having high friction resistance and high corrosion resistance. The shape of the outer face of this washer 26 can be a D-cut shape having a portion of its outer circumference removed, or a width across flats shape having two portions of its outer circumference removed parallel with each other, an external gear teeth shape, etc. In correspondence therewith, the cross sectional shape of the guide portion 24G can be a D-cut shape, a width across flats shape, an internal gear teeth shape, etc.

With the above-described arrangement, the washer 26 subjected to the urging force of the coil spring 27 comes into contact with the boss portion 23B of the impeller 23. Hence, under the urging force of the coil spring 27, the impeller 23 is displaced toward the partition wall 22, as being guided by the support shaft 25. Further, the direction of this displacement of the impeller 23 is the direction along the rotational axis X, so at the time of displacement, the washer 26 too together with the impeller 23 is displaced. The length of the guide portion 24G in the direction along the rotational axis X is set such that at the time of the above displacement too, the guide portion 24G can maintain the engaged state relative to the washer 26. Incidentally, when the impeller 23 is rotated, the protruding end of the boss portion 23B of the impeller 23 comes into contact with the washer 26 which is kept under the non-rotatable state, thus being rotated. However, as cooling water enters this contacting portion for lubrication, smooth rotation is made possible.

[Second Unit: Partition Wall]

The partition wall 22 defines the circular insertion hole 22H around the rotational axis X for allowing insertion of the drive shaft 13. This partition wall 22 is fixed to the second unit housing 21 with a plurality screws 28.

Further, when the disc portion 23A of the impeller 23 is placed in gapless contact with the partition wall 22, the urging force of the coil spring 27 acts on the partition wall 22 via the impeller 23. For the purpose of suppressing deformation of the partition wall 22 by this force, at the center portion of the partition wall 22, there is formed a bulging face 22A bulging stepwise on the impeller side. And, the insertion hole 22H is formed in this bulging face 22A.

[Connection and Detachment]

The first unit housing 11 is connected to the second unit 20 via the plurality of connecting bolts 16 extending through the flange-like portion 11A. Therefore, by releasing the fastening with these connecting bolts 16, the first unit housing 11 can be detached from the second unit housing 21.

When the first unit 10 is connected to the second unit 20, as described hereinbefore, the engaging portion 13T of the drive shaft 13 is engaged with the engaging hole 23T of the impeller 23 and the support shaft 25 is inserted through the supporting hole 23S of the impeller 23. Further, when the engine E is stopped, the washer 26 loosely fitted on the support shaft 25 abuts against the protruding side end portion of the boss portion 23B of the impeller 23, so the urging force of the coil spring 27 acts on the impeller 23 via the washer 26, whereby the impeller 23 is placed in gapless contact with the partition wall 22. With this, the insertion hole 22H is closed by the impeller 23.

On the other hand, at the time of operation of the engine E, in association with rotation of the pulley 12, the drive shaft 13 is rotated and the impeller 23 is rotated. With this rotation of the impeller 23, the cooling water is suctioned in the direction along the rotational axis X and also cooling water is sent out in the centrifugal direction. As a current of cooling water is made as described above, a differential pressure between the discharge and the suction acts on the impeller 23 in the direction along the rotational axis X. Under the action of this differential pressure, the impeller 23 is displaced in the direction of moving the disc portion 23A away from the partition wall 22, as shown in FIG. 1 and FIG. 2.

By this displacement, at the time of operation of the engine E, the impeller 23 is maintained under the state separated from the partition wall 22, so that cooling water can be sent smoothly and effectively.

For instance, when the first unit 10 is to be detached from the second unit 20 for the purpose of replacement of the ball bearing 14, the mechanical seal 15, etc. for instance, an operation of removing the plurality of connecting bolts 16 will be carried out, while the engine E is kept stopped. After this, by an operation of withdrawing the first unit 10 in the direction along the rotational axis X, the engaging portion 13T of the drive shaft 13 is pulled out of the engaging hole 23T of the impeller 23, whereby detachment of the first unit 10 is made possible, as illustrated in FIG. 3.

And, when the first unit 10 is to be detached, the first unit 10 generally will be moved in the direction for its detachment from the second unit 20 in the rotational axis X. With this movement, the drive shaft 13 is displaced in the direction of pulling the engaging portion 13T of this drive shaft 13 out of the engaging hole 23T of the impeller 23, thus effecting the detachment between the drive shaft 13 and the impeller 23.

Also, when the engine E is stopped, under the effect of the urging force of the coil spring 27, the disc portion 23A of the impeller 23 is placed in gapless contact with the partition wall 22 to close the insertion hole 22H. With this gapless contact, when the first unit 10 is detached, no leakage of cooling water on the engine side from the insertion hole 22H of the partition wall 22 will occur.

With the above arrangement, at the time of maintenance such as replacement of the ball bearing 14 of the first unit 10, an operation of draining cooling water from the engine E is not needed, so the maintenance operation can be carried out easily. Further, when the first unit 10 is detached, the reservoir space D is opened, so that even if cooling water is reserved therein, this cooling water can be discharged.

Conversely, when the first unit 10 is to be connected to the second unit 20, a reverse operation will be effected. This operation will involve no difficulty, as long as appropriate care is taken to insert the engaging portion 13T of the drive shaft 13 into the engaging hole 23T of the impeller 23 in the rotational phase for their engagement.

[Other Embodiments]

The present invention can be embodied alternatively, than the foregoing embodiment.

(a) In the face of the disc portion 23A of the impeller 23 facing the partition wall 22 or the face of the partition wall 22 facing the impeller 23, there can be provided an elastic material capable of being deformed to allow flexible facing relative to the other.

Figure 4:
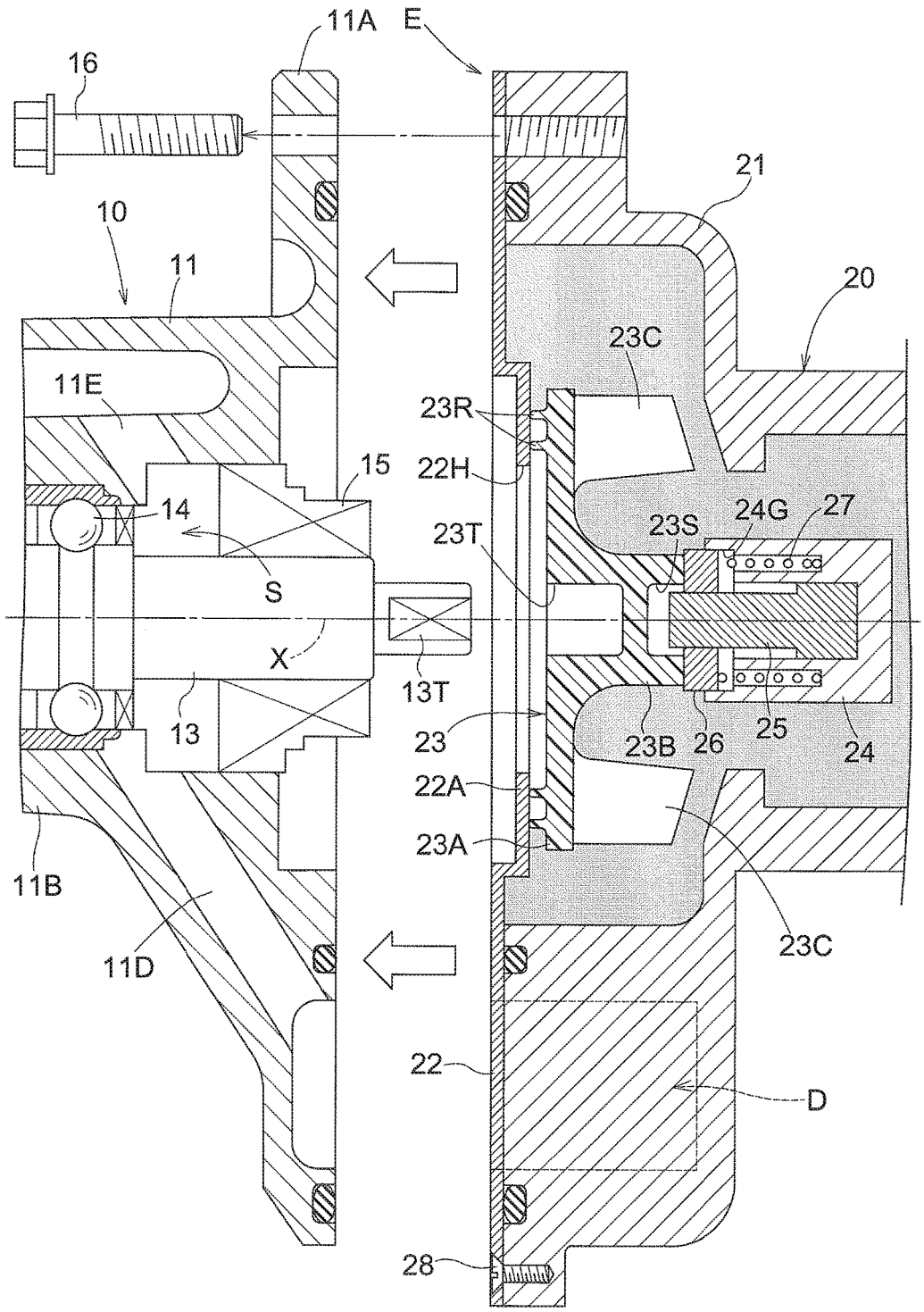
FIG. 4 a section view showing a water pump according to a further embodiment (a), and FIG. 5 a section view showing a water pump according to a further embodiment (b).

As a specific example of this further embodiment (a), in FIG. 4, in the disc portion 23A of the impeller 23, in the face thereof facing the partition wall 22, there are formed lip portions 23R in the form of projections as an elastic material in the region annular around the rotational axis X. Incidentally, in this figure, a plurality of such lip portions 23R are formed coaxially. Instead, only one such lip portion 23R can be provided.

With formation of the lip portion(s) 23R described above, even if there exists a certain amount of unevenness in the surface of the partition wall 22, when the impeller 23 is displaced to a position in contact with the partition wall 22, the lip portion(s) 23R are elastically and flexibly deformed to eliminate gaps relative to the impeller 23. Consequently, the partition wall 22 can effectively close and seal the insertion hole 22H, thus preventing leakage of cooling water.

As a minor modification arrangement of this further embodiment (a), an elastic material can be provided in a region of the surface of the partition wall 22 facing the impeller 23, which region surrounds the insertion hole 22H. With this arrangement too, gap between the impeller 23 and the partition wall 22 can be eliminated, so that the insertion hole 22H can be closed effectively for prevention of cooling water leakage.

Figure 5:
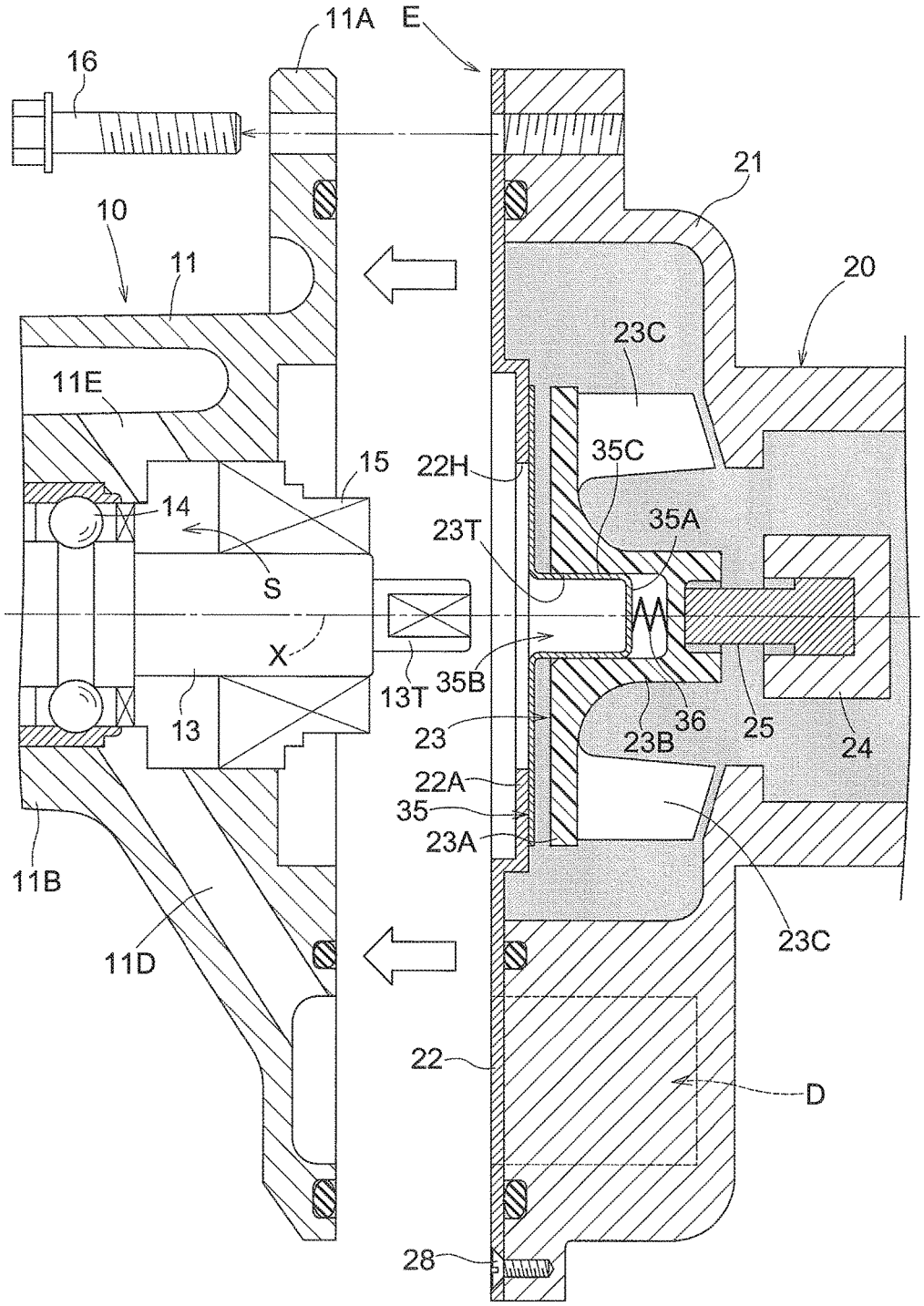

(b) As shown in FIG. 5, there is provided a disc-shaped closing member 35 dedicated to closure of the insertion hole 22H of the partition wall 22. In this arrangement, at the center of the closing member 35, there is provided a protruding portion 35A which protrudes to the impeller side. And, inside this protruding portion 35A, there is formed an engaging receded portion 35B engageable with the engaging portion 13T of the drive shaft 13. Further, in the outer face of the protruding portion 35A, there is formed an engaging face 35C engageable with the engaging hole 23T of the impeller 23 and a spring 36 is disposed between the impeller 23 and the closing member 35.

With the above arrangement, when the drive shaft 13 is displaced in the withdrawing direction, under the urging force of the spring 36, the closing member 35 is displaced in the direction approaching the partition wall 22 and then comes into gapless contact with the partition wall 22, thus reaching a state of closing the insertion hole 22H of the partition wall 22.

This arrangement does not require an arrangement for displacing the impeller 23 in the direction along the rotational axis X. So, the arrangement for supporting the impeller 23 is simplified.

As a minor modification arrangement of this further embodiment (b), it is also conceivable to configure the closing member such that the closing member is slid along the face of the partition wall 22 to close its insertion hole 22H, when the drive shaft 13 is displaced in the withdrawing direction.

(c) In place of the coil spring 27, e.g. an electromagnetic solenoid can be employed as the "urging member" for urging the impeller 23 in the direction toward the partition wall 22. With such arrangement employing an electromagnetic solenoid, by maintaining the solenoid under a non-excited state at the time of operation of the engine E, there is generated no force for displacing the impeller 23 in the direction toward the partition wall 22, so the impeller 23 can always be rotated lightly and smoothly. Further, when the first unit 10 is to be detached from the second unit 20, by rendering the solenoid into an electrically excited state, the impeller 23 can be brought into gapless contact with the second unit 20, so that leakage of cooling water from the insertion hole 22H of the partition wall 22 can be prevented in a reliable manner.

(d) The water pump relating to the present invention is not limited to the type in which the drive shaft 13 is driven by a drive power of the engine E. Instead, it can be configured as an electric driven water pump in which a drive force of an electric motor is transmitted to the drive shaft 13. In the case of such configuration too, the electric motor and the drive shaft 13 can be detached together with the first unit 10, so readiness of maintenance can be improved.

INDUSTRIAL APPLICABILITY

The present invention is applicable to a water pump in which an impeller or the like is driven to rotate by a driving force from a drive shaft.

REFERENCE SIGNS LIST

10: first unit
11F: drain passage
13: drive shaft
20: second unit
22: partition wall
22H: insertion hole
23: impeller, closing member
24: supporting member
25: support shaft
27: urging member, coil spring
35: closing member
E: internal combustion engine (engine)
T: communication chamber
X: rotational axis

The invention claimed is:

1. A water pump comprising:

a first unit having a drive shaft rotatably driven; and a second unit having a partition wall defining an insertion hole for the drive shaft, the second unit being configured to circulate cooling medium in association with rotation of the drive shaft, the second unit being connectable to and detachable from the first unit at the partition wall;

wherein the second unit includes a closing member for closing the insertion hole when the first unit is detached from the second unit while the second unit is supported to an internal combustion engine;

the second unit includes an impeller for circulating the cooling medium;

the impeller is configured to be able to approach the partition wall along an extending direction of the drive shaft, thus constituting the closing member; and the second unit includes an urging member for urging the impeller to a side of the partition wall.

2. The water pump according to claim 1, wherein:

the impeller is supported rotatably by a support shaft disposed on a side opposite to the partition wall;

the second unit includes a support for supporting the support shaft; and a coil spring acting as the urging member is disposed between the support and the impeller.

3. The water pump according to claim 2, wherein the impeller includes an engaging hole formed on the partition wall side and connected with the drive shaft and a supporting hole formed on the side opposite to the partition wall and allowing insertion of the support shaft therein, the engaging hole and the supporting hole being formed independently so as not to communicate with each other.

4. The water pump according to claim 1, wherein the impeller includes, on a face thereof facing the partition wall, an elastically deformable resin layer.

5. The water pump according to claim 1, wherein the first unit includes a drain passage capable of discharging the cooling medium to be stored in a communication chamber provided in mating faces of the first unit and the second unit, before the first unit is detached from the second unit.

* * * * *